United States Patent [19]

Davis et al.

[11] Patent Number: 4,949,458

[45] Date of Patent: Aug. 21, 1990

[54] KNIFE

[75] Inventors: Roger I. Davis, Didsbury; David B. Scott, Halfway, both of Great Britain

[73] Assignee: The Shirley Institute, Manchester, England

[21] Appl. No.: 290,845

[22] Filed: Dec. 29, 1988

Related U.S. Application Data

[63] Continuation of Ser. No. 70,418, Jul. 7, 1987, abandoned.

[30] Foreign Application Priority Data

Jul. 8, 1986 [GB] United Kingdom ..... 8616636

[51] Int. Cl.[5] ..... B26B 3/06

[52] U.S. Cl. ..... 30/162; 30/161; 30/286

[58] Field of Search ..... 30/151, 155, 161, 162, 30/286, 164

[56] References Cited

U.S. PATENT DOCUMENTS

| | | | |
|---|---|---|---|
| 2,474,609 | 6/1949 | Wolf . | |
| 2,607,987 | 8/1952 | Bethenhausen . | |
| 3,999,290 | 12/1976 | Wood . | |
| 4,091,537 | 5/1978 | Stevenson, Jr. | 30/286 |
| 4,209,900 | 7/1980 | Gilbert | 30/162 |
| 4,393,587 | 7/1983 | Kloosterman . | |
| 4,586,256 | 5/1986 | Weimann | 30/162 |

FOREIGN PATENT DOCUMENTS

| | | |
|---|---|---|
| 1272169 | 7/1968 | Fed. Rep. of Germany . |
| 2926809 | 1/1980 | Fed. Rep. of Germany . |
| 649406 | 7/1951 | United Kingdom . |
| 1497069 | 1/1978 | United Kingdom . |
| 1517565 | 7/1978 | United Kingdom . |
| 2078153 | 1/1980 | United Kingdom . |
| 2169539 | 7/1986 | United Kingdom . |

*Primary Examiner*—Douglas D. Watts
*Assistant Examiner*—Willmon Fridie, Jr.
*Attorney, Agent, or Firm*—Charles E. Baxley

[57] ABSTRACT

A knife of the kind having a blade (14, 43) and a handle has an extendible and retractable blade edge guard (16, 45). When the blade (14, 43) is extended, any violent movement of the knife with the cutting edge in a leading attitude acts inertially to disengage a detent (27, 55) from a recess (28, 57) in the guard (16, 45) so that a tension spring (17, 46) quickly extends the guard (16, 45) into its projecting, operative position to guard the blade edge (21, 50) and prevent at least serious injury. When the blade carrier (13, 42) is fully retracted, its engagement with a part (31, 58) of the guard (16, 45) causes that also to retract and be engaged again by the detent (27, 55) due to spring-bias.

7 Claims, 3 Drawing Sheets

KNIFE

This is a continuation of application Ser.. No. 070,418 filed Jul. 7, 1987 now abandoned.

This invention relates to a knife of the kind (hereinafter termed a "knife of the kind referred to") comprising a blade and a handle.

British patent application No. 8,530,435 points out, in discussing accidents caused by hand knives in industry, that the most serious injuries occur when the blade, forcibly applied to the work-piece, slips and strikes the limbs or body of the user. The aforesaid patent application also mentions that in such accidents the user may be applying a force of such magnitude (circa 150 N) that the knife, at the moment of slipping, can move with an acceleration ten times that of gravity.

British patent application No. 8,530,435 discloses and claims a knife of the kind referred to incorporating acceleration detection means adapted to cause automatic retraction of the blade into the handle upon detection of violent movement of the knife at least with the cutting edge of the blade in a leading attitude.

As seen from one aspect of the present invention there is provided a knife of the kind referred to incorporating acceleration detection means adapted whilst leaving the blade externally of the handle to render it less hazardous upon detection of violent movement of the knife at least with the cutting edge of the blade in a leading attitude.

In one embodiment said means causes automatic movement of a guard into operative position to guard the cutting edge of the blade.

Preferably the aforesaid movement of the guard is projection thereof out of the handle.

In another embodiment said means causes pivoting movement of the blade about a transverse axis to swing its cutting edge away from the direction of travel of the knife.

In a third embodiment said means causes rotation of the blade through at least 90° about an axis parallel with its cutting edge.

The invention will be described by way of examples with reference to the accompanying drawings, wherein.

Figure 2:
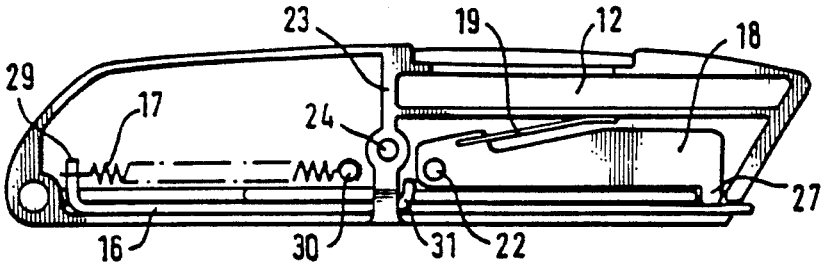
FIG. 2 is a side elevation of the other "half" of the knife of FIG. 1 with the guard latched and inoperative.
Figure 3:
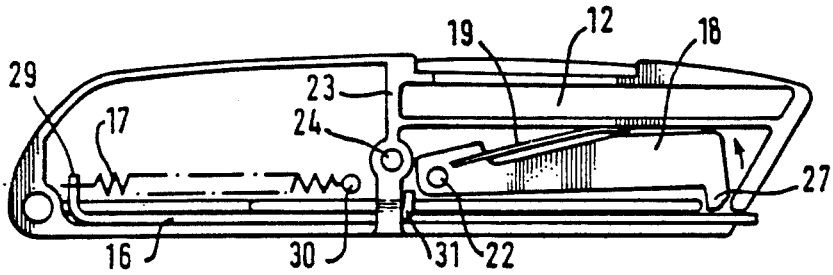
Figure 4:
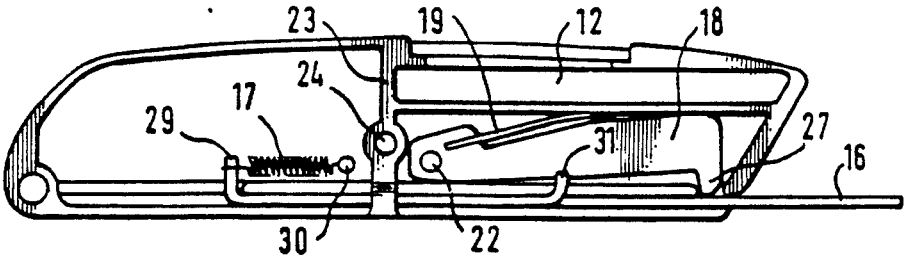
Figure 5:
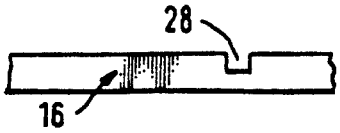
Figure 11:
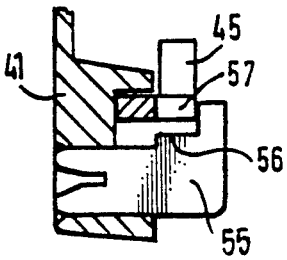
Figure 6:
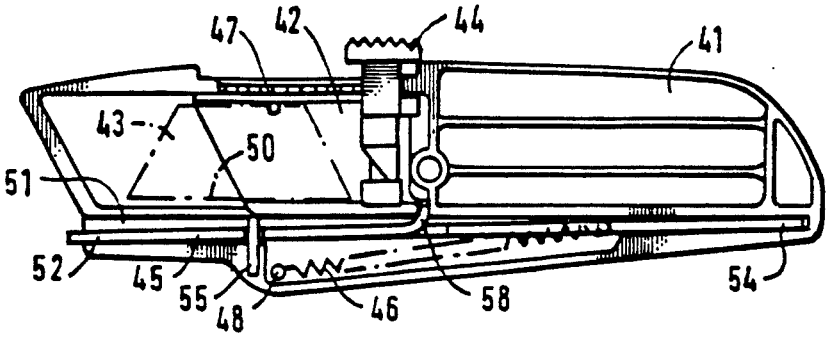
Figure 7:
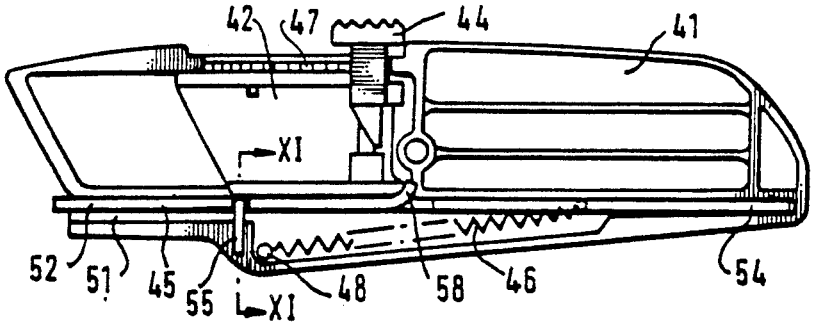
Figure 8:
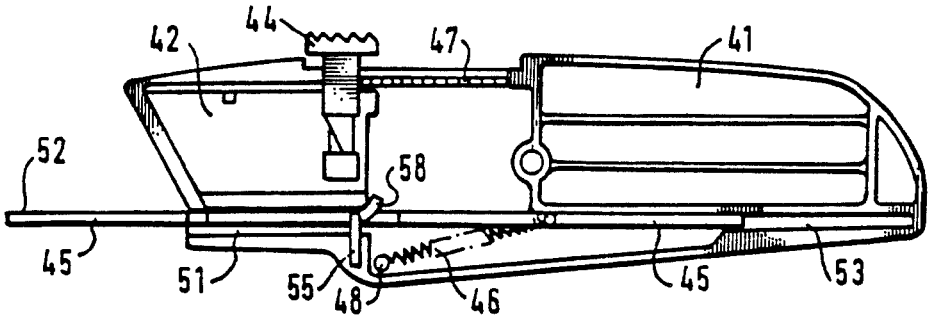
Figure 9:
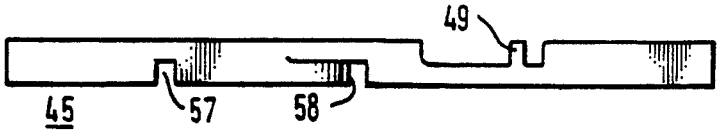
Figure 10:
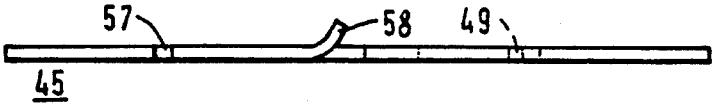

FIG. 3 corresponds to FIG. 2, showing the guard just unlatched;

FIG. 4 corresponds to FIG. 3, showing the guard projecting and operative;

FIG. 5 is a fragmentary view of part of the guard of FIGS. 2 to 4;

FIG. 6 is a side elevation of a second knife embodying the present invention with one half of the handle removed, showing the guard latched and inoperative;

FIG. 7 corresponds to FIG. 6, showing the guard just unlatched;

FIG. 8 corresponds to FIG. 7, showing the guard projecting and operative;

FIGS. 9 and 10 are a plan view and a side elevation respectively of the guard of the knife of FIGS. 6 to 8; and FIG. 11 is a section on line XI—XI of FIG. 7.

Figure 1:
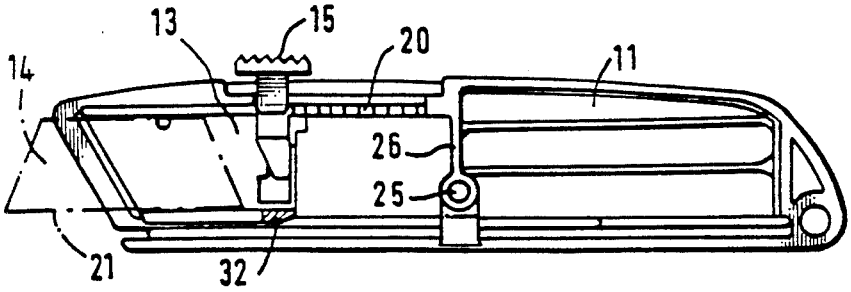
FIG. 1 is a side elevation of one "half" of a first knife embodying the present invention.

Referring to FIGS. 1 to 5, the first knife comprises the following components: first and second handle halves 11 and 12; a blade carrier 13; a blade 14 (shown by chain-dot lines in FIG. 1); an operating button 15; a compression spring (not shown) acting on the operating button 15; an elongate guard 16; a tension spring 17; a "bob" or latch member 18; and a leaf spring 19. Referring particularly to FIG. 1, the blade carrier 13 with blade 14 is slidably arranged in the handle (when handle halves 11, 12 are assembled together in well known manner) for advancing and retracting the blade 14 under the control of the spring-biased operating button 15 which engages a row of first detents 20 which are formed in the handle half 11.

Referring now particularly to FIGS. 2 to 5, the guard 16 is longitudinally slidably guided within the handle for movement between a retracted position (FIGS. 2 and 3) in which it is inoperative, and a projecting position (FIG. 4) in which it is operative to guard the cutting edge 21 of blade 14.

The latch member 18 is pivoted to the handle half 12 by a fixed pivot pin 22 just forward of a generally central "bridge" portion 23. The bridge portion 23 contains a screw-hole 24 for a screw (not shown) which also extends through a hole 25 in a corresponding bridge portion 26 in handle half 11 to join handle halves 11, 12 together.

The leaf spring 19 biases the latch member 18 downwardly towards the latching position of FIG. 2. If the handle is moved violently downwards (as seen in FIGS. 1 to 4) the inertia of the latch member 18 moves latch member 18, relative to the handle, upwardly (see FIG. 3) against leaf spring 19. A downwardly projecting front end portion 27 of latch member 18 forms a second detent for engaging in a recess 28 (FIG. 5) in the guard 16 to hold the guard 16 retracted into the handle as shown in FIG. 2. The tension spring 17 is connected between an upwardly bent rear end portion 29 of guard 16 and a pin 30 which is an integral fixed part of handle half 12 just to the rear of bridge portion 23, to bias guard 16 towards its projecting, operatively position (FIG. 4).

An upwardly projecting portion 31 of guard 16 is engageable by a portion 32 (shown hatched in FIG. 1) of blade carrier 13 so that retraction of blade carrier 13 and blade 14 (by means of button 15) also causes retraction of guard 16.

In use of the knife shown in FIGS. 1 to 5, the button 15 can be manipulated in well-known manner for extending and retracting the blade 14. If the blade 14 is fully retracted, the guard 16 is also fully retracted (see above) by interengagement of portions 31 and 32 of guard 16 and blade carrier 13 respectively, until recess 28 arrives opposite front end portion or "detent" 27 of latch member 18, whereupon leaf spring 19 causes detent 27 to engage in the recess 28 to hold guard 16 retracted, against the tension of spring 17.

If blade 14 is then extended for use by manipulation of button 15, the guard 16 remains retracted, unless and until any violent downward movement (as seen in FIGS. 1 to 4) results in inertial relative upward movement (see FIG. 3) of latch member 18 to release guard 16, which is then extended by the spring 17 to the projecting, operative position shown in FIG. 4 to guard the cutting edge 21 of blade 14, this taking place hopefully quickly enough to prevent injury or at least serious injury.

Referring to FIGS. 6 to 11, the second knife comprises: a first handle half 41; a second handle half (not shown); a blade carrier 42; a blade 43 (shown by chain-dot lines in FIG. 6 only); an operating button 44; a compression spring (not shown) acting upon the operating button 44; an elongate guard 45; and a tension spring 46.

The second half (not shown) can be removed from the first handle 41 leaving items 42 to 46 all still in place in handle half 41. The manner in which the two handle halves are assembled and secured together is the same as for the first knife.

Additionally, the manner in which the blade 43 can be extended and retracted by manipulation of button 44, which engages first detents 47 in first handle half 41, is the same (mutatis mutandis) as for the first knife. The tension spring 46 is connected between a pin 48 fixed to handle half 41 (at the front end of spring 46) and a spring anchor 49 (see FIG. 9) which is an integral part of guard 45 at the rear end of spring 46.

The guard 45 is longitudinally slidably guided in handle half 41 for movement between retractable positions (see below, FIGS. 6 and 7) in which it is inoperative and an extended, projecting position (FIG. 8) in which it is operative to guard the cutting edge 50 (FIG. 6) of blade 43.

A longitudinally guideway 51 at the front end of handle half 41 is sufficiently deep (in the plane of FIGS. 6 to 8) to permit the front end 52 of guard 45 to move between a lowered position (FIG. 6) and a raised position (FIG. 7). A corresponding guideway 53 at the rear end of handle half 41 is less deep, in fact, only just deep enough to permit the guard 45 to pivot about its rear end 54 when its front end 52 moves between the lowered and raised positions of FIG. 6 and 7.

The tension spring 46 not only biases the guard 45 towards its projecting, operative position (FIG. 8) but also biases the guard 45 downwardly, that is, biases the front end 52 downwardly, towards the lowered position of FIG. 6.

A detent plate 55 (see particularly FIG. 11) is fixed in handle half 41. When the guard 45 is in its lowered position of FIG. 6, an edge portion 56 of detent plate 55 engages in a recess 57 of guard 45 to hold the guard 45 retracted against the tension of spring 46.

If the blade 43 is extended (as in FIG. 8) and the knife is then subjected to violent downward movement, the inertia of the guard 45 causes its front end 52 to move upwardly from the latched position of FIG. 6 to the unlatched position of FIGS. 7 and 11 (against the downward bias of spring 46) to disengage edge portion 56 of detent plate 55 from recess 57 of guard 45, whereupon the guard 45 is extended by spring 46 into its projecting, operative position of FIG. 8, to guard the cutting edge 50 of blade 43. As with the first knife, this hopefully takes place quickly enough to prevent at least serious injury.

The guard 45 is formed with an upwardly extending projection 58 which is engageable by the blade carrier 42 so that retraction of blade carrier 42 causes retraction of guard 45.

Because spring 46 biases guard 45 always downwardly, full retraction of guard 45 results in its being moved downwardly into the position of FIG. 6, in which the edge portion 56 of detent plate 55 engages in recess 57, to hold the guard 45 retracted.

In modifications (not shown) of the first knife of FIGS. 1 to 5 or the second knife of FIGS. 6 to 11, the blade carrier and/or the guard may be mounted in the other handle half to that shown, or in both handle halves together.

If desired, means may be provided to latch the guard in its extended position covering the blade, which means is only released upon return of blade and guard to the interior of the handle.

In a different arrangement the acceleration detection means causes the blade to pivot about a transverse axis at its junction with the handle to swing its cutting edge away from the direction in which the knife is then travelling.

In yet a different arrangement the acceleration detection means causes rotation of the blade through at least 90° about an axis parallel with its cutting edge.

We claim:

1. A hand knife comprising a handle having a blade with a cutting edge extendable from the handle, a guard movable between a normally retracted position in the handle and an extended position covering the cutting edge of the blade when extended from the handle, acceleration detection means in the handle and comprising a movable mass for detecting violent movement of the knife, biasing means for moving the guard from said retracted position to said extended position, the acceleration detection means connected to the biasing means to actuate said movement of the guard to said extended position.

2. The hand knife according to claim 1 with, a spring serving as the biasing means, the spring connected between the guard and the handle.

3. The hand knife according to claim 2 wherein a detent acts upon the guard to restrain said biasing means until it is overcome by said acceleration detection means on detecting said violent movement.

4. The hand knife according to claim 3 wherein the detent is provided as part of a separate member acting as an inertial mass and movable housed within the handle.

5. The hand knife according to claim 4 wherein said separate member is pivoted within the handle.

6. The hand knife according to claim 5 wherein said separate member is spring-biased against releasing the blade.

7. The knife according to claim 3 wherein the guard forms an inertial mass which disengages due to inertia from the detent upon said violent movement of the knife.

* * * * *